United States Patent [19]

Lecinski

[11] Patent Number: 4,607,757

[45] Date of Patent: Aug. 26, 1986

[54] ANTI-SPIN INTERFERENCE FIT OF PRESS-SEAL INSERT AND METHOD OF ASSEMBLY

[75] Inventor: Frank H. Lecinski, Harwood Heights, Ill.

[73] Assignee: Continental White Cap, Inc., Northbrook, Ill.

[21] Appl. No.: 719,159

[22] Filed: Apr. 2, 1985

[51] Int. Cl.[4] ..... B65D 41/08

[52] U.S. Cl. ..... 215/246; 53/442; 53/487; 53/488; 215/274; 215/335

[58] Field of Search ..... 215/246, 274, 335; 53/442, 487, 488

[56] References Cited

U.S. PATENT DOCUMENTS 3,603,472 9/1971 Lecinski ..... 215/253

FOREIGN PATENT DOCUMENTS 1524512 9/1978 United Kingdom ..... 215/246

*Primary Examiner*—Donald F. Norton

*Attorney, Agent, or Firm*—Charles E. Brown

[57] ABSTRACT

This relates to press-on closure assemblies for containers. It is known to provide containers which are formed of plastic or glass with a neck finish including an end sealing surface and a recessed, generally cylindrical, but possibly tapered, surface disposed between two opposed axially spaced shoulders. A separately formed insert is pressed over the neck finish and positioned between the two shoulders in opposed relation to the recessed surface of the neck finish. The insert has lugs or threads for interlocking engagement with a closure which may be removed by rotation. The closure and the insert are preassembled and pressed onto the container neck finish with a gasket or sealing material carried by the closure engaging the end sealing surface. The past problem is the rotation of the insert relative to the container neck finish, thereby preventing removal of the closure. It is proposed to form the insert of a thermoplastic resin and heating the insert immediately before the application thereof to the container neck finish. This results in softening of the insert facilitating its telescoping over the container neck finish. However, most particularly, the thermoplastic resin of the insert is heated to a temperature whereat a desired reaction takes place with the resultant shrinkage of the insert to a size less than the original size wherein in lieu of conventional non-reliable press fit, there is a shrink fit which is greater than is possible with the press fit.

9 Claims, 7 Drawing Figures

(a)
HEAT
(b)
ASSEMBLE
(c)
COOL

ANTI-SPIN INTERFERENCE FIT OF PRESS-SEAL INSERT AND METHOD OF ASSEMBLY

This invention relates in general to new and useful improvements in closures for containers, and more particularly to improvements of known closures of the press-seal type.

In accordance with the teachings of U.S. Pat. No. 3,603,472 granted Sept. 7, 1971, of which I am a co-inventor, there is provided a separate insert or fitment which is telescoped over the neck finish of the container and which insert or fitment is provided with lugs or threads for interlocking engagement with a closure cap. The insert and the closure cap are assembled and then the assembly is applied to the container neck finish by pressing the same on.

In accordance with the known art, the container is provided with a neck finish which terminates in an end sealing surface and which includes a recessed surface disposed between two opposed axially spaced shoulders. The recessed surface is of a circular cross section and may be slightly tapered if desired.

The insert or fitment is in the form of a sleeve formed of plastic material and may have at the lower end thereof a radially outwardly projecting flange which is engaged by the lower edge of the skirt of the closure. The sleeve has integrally molded therewith lugs or threads which receive a closure in the normal manner. The closure will be provided on the under surface thereof with a band of gasket or sealing material for engagement with the end sealing surface of the container.

It is to be understood that the recessed surface of the container must be recessed sufficiently for the upper shoulder to provide a good interlock with the insert so that the insert and closure assembly will not pop off of the container. On the other hand, while the insert is normally formed of a plastic material, the resiliency of the insert is not such that the desired frictional interfit between the insert and the container neck finish will prevent rotation of the insert relative to the container neck finish when one attempts to release the closure.

In the past, the interlock between the insert and the container neck finish has been enhanced by radiating ribs normally positioned in the corner between the container neck finish surface and one of the shoulders. Even this has not provided a sufficient resistance to rotation of the insert relative to the container neck finish to assure against rotation of the insert relative to the container.

This invention relates to a modification of the press-seal insert and more particularly to the mode of applying the same. More particularly, it relates to the heating of the plastic material insert to a temperature wherein the plastic material will soften and facilitate pressing of the insert onto the container neck finish without damage. However, more particularly it relates to the heating of the plastic material of the insert to a temperature whereat there will be a slight reaction in the plastic material causing a small amount of shrinkage over and above that resulting from a temperature change to take place.

With the above and other objects in view that will hereinafter appear, the nature of the invention will be more clearly understood by reference to the following detailed description, the appended claims, and the several views illustrated in the accompanying drawing.

FIGS. 1*a, b* and *c* are schematic views showing the heating of the insert and closure assembly, the application of the assembly to a container neck finish and finally the cooling and shrinking of the insert in accordance with this invention.

Figures 1, 2, 3, 4, 5:
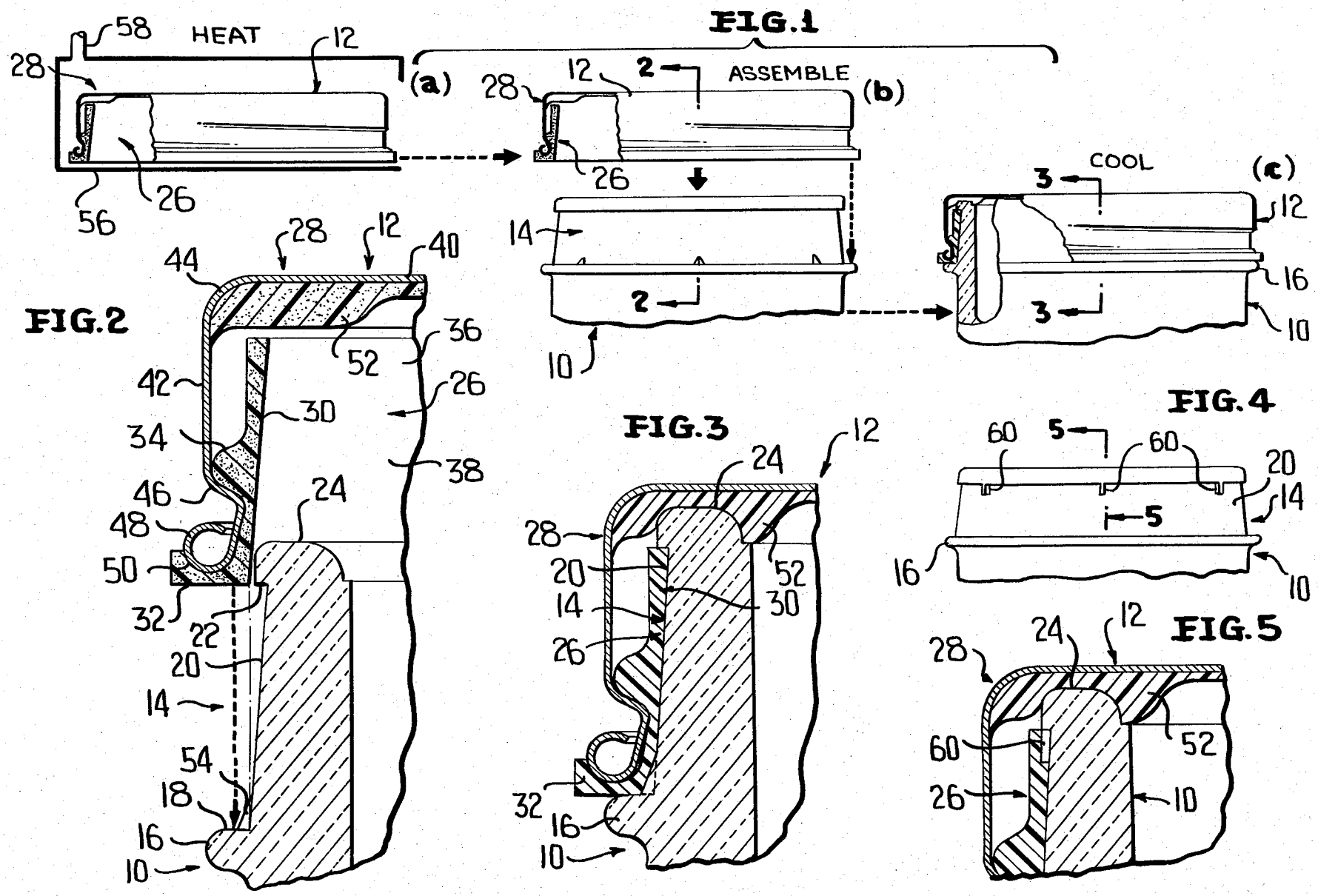
FIG. 2 is an enlarged fragmentary vertical sectional view taken generally along the line 2—2 of FIG. 1*b* and shows the insert and closure assembly being applied to the container neck finish.
FIG. 3 is an enlarged fragmentary vertical sectional view taken generally along the line 3—3 of FIG. 1*c* and shows the insert shrunk into place tightly about the container neck finish.
FIG. 4 is a fragmentary elevational view of a slightly modified form of container neck finish.
FIG. 5 is an enlarged fragmentary vertical sectional view taken generally along the line 5—5 of FIG. 4 and shows the mechanical interlock between the insert and the container neck finish of FIG. 4.

Referring now to the drawing in detail, it will be seen that there is illustrated in FIG. 2 a container 10 configurated to receive an insert and closure assembly 12 by pressing the assembly onto the container neck finish. The container 10 will be formed of glass or plastic and be of a rigid construction. The upper part of the container 10 is provided with a special neck finish, generally identified by the numeral 14. This neck finish includes a radially projecting rib 16 which defines a lower shoulder 18 for a recessed surface 20 which is of a circular cross section. The surface 20 extends axially between the aforementioned shoulder 18 and an upper shoulder 22. The surface 20 is preferably tapered so as to have a minimum diameter adjacent the shoulder 22. It is, however, feasible that the surface 20 be cylindrical.

The neck finish 14 also includes an end sealing surface 24.

The insert and closure assembly 12 includes an insert 26 and a closure 28. The insert 26 is formed of a thermoplastic resin and includes a sleeve 30 which is provided at its lower end with an integral radially outwardly projecting flange 32. The flange 32 serves to axially position the closure 28 on the insert 26.

The sleeve 30 is provided with integrally molded, radially outwardly projecting thread means 34 of the lug or conventional thread type.

It is to be understood that the inner surface of the sleeve 30 generally defines a bore 36 with the inner surface being identified by the numeral 38. The configuration of the surface 38 corresponds to that of the surface 20 and the diameters of corresponding portions of the surfaces 20 and 38, when the insert 26 is first formed, is preferably one wherein there would be a press fit between the surfaces.

The closure 28 is of a conventional type and may be formed of metal. The closure 28 is illustrated as having an end panel 40 joined to a skirt 42 by a rounded corner or radius 44. A lower portion of the skirt 42 is configurated to define a thread 46 and terminates in a radially outwardly directed curl 48. Preferably the flange 32 is provided with a seat 50 for receiving the curl 48 in sealed relation.

The end panel 40 of the closure 28 is provided with an annulus of a suitable gasket or sealing material 52.

As is disclosed in U.S. Pat. No. 3,603,472, the closure 28 is assembled with the insert 26. Then the insert and closure assembly 12 is pressed onto the container neck finish 14 after the desired product has been placed within the container 10. As is best shown in FIG. 3, the proportions of the various components is such that the end sealing surface 24 of the container neck finish is embedded in the gasket 52 to form the desired closing seal for the container 10.

Although there may be a slight press fit between the surfaces 20 and 38, the frictional resistance to rotation of the insert 26 relative to the container neck finish 14 is not sufficiently great to prevent rotation of the insert 26 relative to the container 10 as opposed to the required rotation of the closure 28 relative to the insert 26 for effecting opening of the container.

In the past, as is also disclosed in U.S. Pat. No. 3,603,472, the surface 20 adjacent the shoulder 18 may be provided with radially outwardly projecting ribs 54 for interlocking with the lower portion of the insert 26.

Notwithstanding the positive interlock between the lugs 54 and the insert 26 as well as the frictional resistance to rotation between the surfaces 20 and 38, in certain instances, the insert 26 will rotate with the closure cap 28 as opposed to remaining stationary, thereby preventing the removal of the closure cap from the container. One of the problems is that in order to obtain the necessary press fit, the insert 26 must pass over the large portion of the upper end of the neck finish which defines the shoulder 22. Thermoplastic resins which are suitable for forming the insert 26 are of restricted resiliency and as a result, the desired press fit between the surfaces 20 and 38 cannot be obtained.

In accordance with this invention, it has been deemed advisable to heat the insert 26 just before it is applied to the neck finish 14 so as to soften the plastic material of the insert and thereby facilitate the pressing of the insert onto the container neck finish. It has been found, however, with respect to this invention that if the thermoplastic resin material of the insert 26 is heated to or slightly above a predetermined temperature at which a slight reaction in the thermoplastic resin will occur, the diameter of the surface 38 will reduce by shrinking beyond that of the original diameter.

Accordingly, in accordance with this invention prior to the insert and closure assembly 12 being applied to the container 10, the assembly 12 is heated to raise the temperature of the thermoplastic resin of the insert 26 to the predetermined temperature or slightly thereabove. This may be effected by passing the insert and closure assembly 12 towards the container 10 through a trough illustrated in FIG. 1*a* and identified by the reference numeral 56. Any suitable heat means may be provided in combination with the trough although it is preferred that the trough be steam heated and be provided with a steam line 58.

As pointed out above, the heated insert 26 may be more readily applied to the container neck finish 14 without damage to the insert due to the softening of the plastic material of the insert 26. However, by heating the thermoplastic resin of the insert 26 to the desired reaction temperature, a shrinkage of the surface 38 beyond the original size may be also effected. Thus when the combination insert and closure 12 is applied to the container neck finish 14, as is shown in FIG. 3, the interfit between the surfaces 20 and 38 is tighter than heretofore possible with the best of press fits. Further, it is repeatable without damage to the insert 26.

Although in the past the ribs 54 have been located adjacent the shoulder 18, as is clearly shown in FIG. 4, ribs 60 may project from the surface 20 adjacent the shoulder 22. The applied insert 26 is shown in FIG. 5 interlocked with the ribs 60.

Although only a preferred disclosure of the method of applying the combined insert and closure assembly has been specifically illustrated and described herein, it is to be understood that minor variations may be made in the insert, the neck finish for receiving the insert, and the method of applying the insert without departing from the spirit and scope of the invention as defined by the claims.

We claim:

1. A method of applying a combination closure and insert to a recessed container neck finish, said method comprising the steps of providing a container having a neck finish including a circular cross sectional surface disposed in recessed relation between and defined by opposed axially spaced shoulders, providing an insert formed of a plastic material which shrinks with respect to a starting size when heated to a predetermined temperature and then cooled and including a sleeve member having an internal bore of circular cross section and a respective diameter corresponding substantially to the diameter of an axially adjacent portion of said cylindrical surface, said sleeve having external closure retaining means of the lug or thread type, providing a closure configurated for sealing engagement with said container neck finish and for rotational interlocking engagement with said insert, assembling said closure on said insert, heating the assembled insert and closure to at least said predetermined temperature, while said insert is at at least said predetermined temperature pressing the assembled insert and closure onto said container with said insert being seated between said shoulders and said closure sealingly engaging said container neck finish, and permitting said insert to cool with the internal cross section of said insert becoming less than the original internal cross section of said insert and tightly gripping said neck finish recessed circular cross sectional surface.

2. A method according to claim 1 wherein the cross section of said insert is initially less than the corresponding cross section of said neck finish surface wherein in the absence of shrinking of said insert there would be a press fit between said insert and said neck finish surface.

3. A method according to claim 1 wherein said predetermined temperature is one whereat said insert is softened and becomes more easily applied and less prone to damage.

4. A method according to claim 1 wherein the plastic material is a thermoplastic resin.

5. A method according to claim 1 wherein said heating is effected by way of steam treatment.

6. A closed container assembly comprising a container having a neck finish including a circular cross sectional surface disposed in recessed relation between and defined by opposed axially spaced shoulders, and a preassembled insert and closure assembly closing said container, said insert and closure assembly comprising a formed plastic material insert telescoped over said surface between said shoulders, said insert having a shrink fit on said surface with said shrink fit being one effected by a thermal reaction within said plastic material sufficient to reduce the size of said insert to be less than its as formed size, and a closure telescoped over said insert and having a seal with said neck finish, said closure having a rotational interlock with said insert.

7. A closed container assembly according to claim 6 wherein said plastic material is a thermoplastic resin.

8. A closed container assembly according to claim 6 wherein said neck finish surface has projecting therefrom adjacent one of said shoulders radially projecting and circumferentially spaced ribs embedded into said insert.

9. A closed container assembly according to claim 6 wherein said shrink fit is tighter than is possible with a press fit only.

* * * * *